US007554495B2

(12) United States Patent
Enoshima et al.

(10) Patent No.: US 7,554,495 B2
(45) Date of Patent: Jun. 30, 2009

(54) ANTENNA APPARATUS

(75) Inventors: Ryouichi Enoshima, Higashiyamato (JP); Takayuki Shimizu, Higashiyamato (JP)

(73) Assignee: Casio Hitachi Mobile Communications Co., Ltd., Tokyo (JP)

( * ) Notice: Subject to any disclaimer, the term of this patent is extended or adjusted under 35 U.S.C. 154(b) by 68 days.

(21) Appl. No.: 11/703,264

(22) Filed: Feb. 7, 2007

(65) Prior Publication Data

US 2007/0205949 A1 Sep. 6, 2007

(30) Foreign Application Priority Data

Feb. 10, 2006 (JP) ..... 2006-033603

(51) Int. Cl.
*H01Q 1/24* (2006.01)

(52) U.S. Cl. ..... 343/702

(58) Field of Classification Search ..... 343/702, 343/700 MS, 741, 866
See application file for complete search history.

(56) References Cited

U.S. PATENT DOCUMENTS

| | | | | |
|---|---|---|---|---|
| 5,903,240 | A * | 5/1999 | Kawahata et al. | 343/700 MS |
| 6,535,170 | B2 * | 3/2003 | Sawamura et al. | 343/702 |
| 6,680,700 | B2 | 1/2004 | Hilgers | |
| 6,717,551 | B1 | 4/2004 | Desclos et al. | |
| 6,950,072 | B2 | 9/2005 | Miyata et al. | |
| 6,956,531 | B2 | 10/2005 | Sugiyama et al. | |
| 6,963,310 | B2 | 11/2005 | Horita et al. | |
| 6,965,346 | B2 * | 11/2005 | Sung et al. | 343/702 |
| 7,034,754 | B2 * | 4/2006 | Hung et al. | 343/700 MS |
| 7,042,400 | B2 | 5/2006 | Okubo et al. | |
| 2003/0174092 | A1 | 9/2003 | Sullivan et al. | |
| 2005/0270240 | A1 | 12/2005 | Qi et al. | |

FOREIGN PATENT DOCUMENTS

| | | |
|---|---|---|
| DE | 103 41 310 A1 | 3/2004 |
| EP | 1 113 524 A2 | 7/2001 |
| EP | 1 414 108 A2 | 4/2004 |
| JP | 8-84013 | 3/1996 |
| JP | 10-209733 | 8/1998 |

(Continued)

OTHER PUBLICATIONS

European Search Report issued in the corresponding European Application No. 07 00 2209.

*Primary Examiner*—Hoang V Nguyen
(74) *Attorney, Agent, or Firm*—Cohen Pontani Lieberman & Pavane LLP

(57) ABSTRACT

An antenna apparatus has a first antenna element and a second antenna element branched from one power feed point. The first antenna element and the second antenna element, which have different lengths, are arranged nearly in a loop as a whole with a predetermined clearance provided between distal ends thereof. The first antenna element and the second antenna element are arranged in such a way that the end faces of the distal ends thereof do not face each other with a lengthwise direction of the end face of the distal end of the first antenna element being approximately orthogonal to a lengthwise direction of the end face of the distal end of the second antenna element. Therefore, the antenna apparatus can suppress electric coupling of a plurality of antenna elements which transmit and/or receive radio waves of different frequency bands.

11 Claims, 7 Drawing Sheets

FOREIGN PATENT DOCUMENTS

| | | |
|---|---|---|
| JP | 2002-076736 | 3/2002 |
| JP | 2002-135028 | 5/2002 |
| JP | 2002-158529 | 5/2002 |
| JP | 2002-185231 | 6/2002 |
| JP | 2002-368535 | 12/2002 |
| JP | 2003-051705 | 2/2003 |
| JP | 2003-124726 | 4/2003 |
| JP | 2004-023620 | 1/2004 |
| JP | 2004-104419 | 4/2004 |
| JP | 2004-166242 | 6/2004 |
| JP | 2004-201281 | 7/2004 |
| JP | 2004-343601 | 12/2004 |
| JP | 2005-142785 | 6/2005 |
| JP | 2005-143044 | 6/2005 |
| JP | 2005-210523 | 8/2005 |
| WO | WO 03/067703 | 8/2003 |
| WO | WO 2004/034513 A1 | 4/2004 |
| WO | WO 2005/048404 | 5/2005 |
| WO | WO 2006/098089 | 9/2006 |

* cited by examiner

ANTENNA APPARATUS

BACKGROUND OF THE INVENTION

1. Field of the Invention

The present invention relates to an antenna apparatus. More particularly, the invention relates to a multiband antenna apparatus capable of transmitting and/or receiving radio waves of different frequency bands.

2. Description of the Related Art

The recent popularization of portable communication terminal apparatuses, typically cellular phones, raises a problem stringent frequency bands to be used in the portable communication terminal apparatuses. This requires a multiband antenna apparatus like a dual-band type, which can transmit/receive radio waves of different frequency bands. The multiband configuration of antenna apparatuses results in increases in the size and quantity of antenna apparatuses. To make cellular phones smaller and lighter, however, more compact antenna apparatuses are demanded.

A chip antenna is frequently used as a compact antenna.

FIG. 7 shows a conventional antenna apparatus 6. A first antenna element 62 and a second antenna element 63 are formed on a flat face portion 611 of a support base member 61. The first antenna element 62 and the second antenna element 63 are arranged with a predetermined clearance between distal ends thereof.

The antenna elements are each adjusted to have an antenna characteristic, for example, as shown in FIG. 8. In FIG. 8, the horizontal axis represents the resonance frequency of each antenna element, and the vertical axis represents the value of a VSWR (Voltage Standing Wave Ratio) at a power feeding end of each antenna element. It is preferable that the VSWR of the frequency band to which each antenna element is made to correspond should be 3.0 or less. With the preference in mind, the antenna characteristic shown in FIG. 8 indicates that one of the first antenna element 62 and the second antenna element 63 corresponds to a frequency band near 800 MHz, while the other antenna element corresponds to a frequency band near 2 GHz.

There is an antenna having a plurality of antenna elements to transmit/receive radio waves of a single frequency band, not plural frequency bands.

For example, Japanese Patent No. 3514305 and Japanese Patent No. 3551368 describe techniques of simultaneously transmitting/receiving two linear polarized components of a radio wave of a single frequency band whose polarization planes are orthogonal to each other.

Specifically, Japanese Patent No. 3514305 discloses an antenna including elements and slots for irradiating two linear polarized components whose polarization planes are orthogonal to each other.

Japanese Patent No. 3551368 discloses an antenna including an antenna element and a power feed line which irradiate a horizontal polarized component and further including a conductive element which irradiates a vertical polarized component.

In the conventional antenna apparatus shown in FIG. 7, the end faces of the distal ends of the two antenna elements are arranged close to each other and facing each other. Accordingly, the distal ends of the two antenna elements show the characteristic of a capacitor.

A capacitance C stored between the distal ends of the two antenna elements is derived from an equation 1 below.

$$C=\epsilon 0\cdot\epsilon r\cdot(S/d) \quad (1)$$

where $\epsilon 0$ is the dielectric constant of vacuum, $\epsilon r$ is the relative permittivity of the support base member (or air), S is the area of each opposing distal end, and d is the distance between the opposing distal ends.

It is apparent from the equation 1 that the value of the capacitance C increases according to the area S of the opposing distal end. According to the conventional antenna apparatus, the area S of the opposing distal end is equivalent to the cross-sectional area of the distal end of the antenna element. Accordingly, the capacitance C according to the size of the cross-sectional area is stored between the distal ends of the two antenna elements. The electric coupling of the antenna elements originating from the storage of the capacitance C is likely to degrade the antenna performance of each antenna element, such as the antenna gain and reception sensitivity.

Even in a case where each antenna element is so adjusted as to correspond to the frequency band of radio waves to be transmitted/received, the electric coupling of the antenna elements, if strong, would cause interference between the antenna elements. Specifically, when one antenna element is adjusted to correspond to a predetermined frequency band, as shown in FIG. 9, the frequency band to which the other antenna element can be adapted deflects according to the amount of the adjustment. When multiple antenna elements interfere with one another, the adjustment of the frequency bands becomes troublesome.

The techniques described in Japanese Patent No. 3514305 and Japanese Patent No. 3551368 are directed to polarization of polarization planes of radio waves to be irradiated from each antenna element. The techniques are premised on transmission/reception of radio waves of the same frequency band. Therefore, the techniques described in Japanese Patent No. 3514305 and Japanese Patent No. 3551368 cannot overcome the foregoing problem of a plurality of which transmit/receive radio waves of different frequency bands.

SUMMARY OF THE INVENTION

Accordingly, it is an object of the invention to provide an antenna apparatus that can suppress electric coupling of a plurality of antenna elements which transmit and/or receive radio waves of different frequency bands.

To achieve the object, according to a first aspect of the invention, there is provided an antenna apparatus having at least two antenna elements branched from one power feed point, wherein the at least two antenna elements have different lengths, and one of the at least two antenna elements and an other one thereof are arranged nearly in a loop as a whole with a predetermined clearance provided between distal ends of the one antenna element and the other antenna element, in such a way that end faces of the distal ends thereof do not face each other with a lengthwise direction of the end face of the distal end of the one antenna element being approximately orthogonal to a lengthwise direction of the end face of the distal end of the other antenna element.

According to a second aspect of the invention, there is provided an antenna apparatus comprising:

a first antenna element which transmits and/or receives radio waves of a predetermined frequency band, a second antenna element which transmits and/or receives radio waves of a frequency band different from the predetermined frequency band, wherein the first antenna element and the second antenna element are arranged nearly in a loop with distal ends thereof being apart from each other by a predetermined distance, in such a way that a lengthwise direction of an end face of the distal end of the first antenna element is different from a lengthwise direction of an end face of the distal end of the second antenna element.

The invention can suppress the opposing areas of the distal ends of antenna elements whose distal ends are arranged apart from each other by a predetermined distance. According to the invention, therefore, the electric coupling of a plurality of antenna elements which transmit and/or receive radio waves of different frequency bands can be suppressed.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

A fold type cellular phone (portable communication terminal apparatus) as an example of a wireless communication apparatus having an antenna apparatus embodying the invention mounted therein will be described below with reference to the accompanying drawings.

Figure 1:
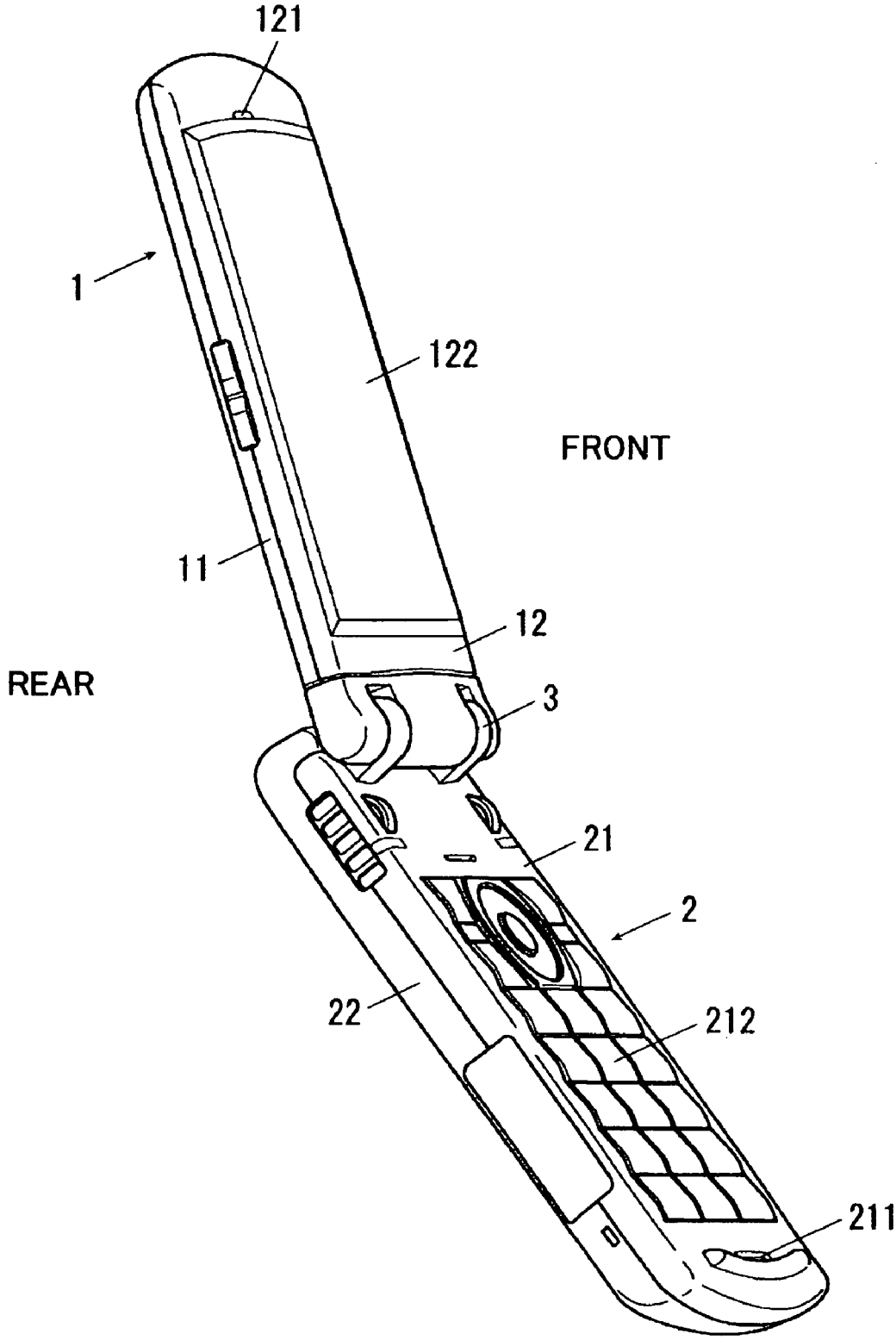
FIG. 1 is a perspective view of an open, fold type cellular phone having an antenna apparatus according to one embodiment of the invention mounted therein as viewed from the front side.
Figure 2:
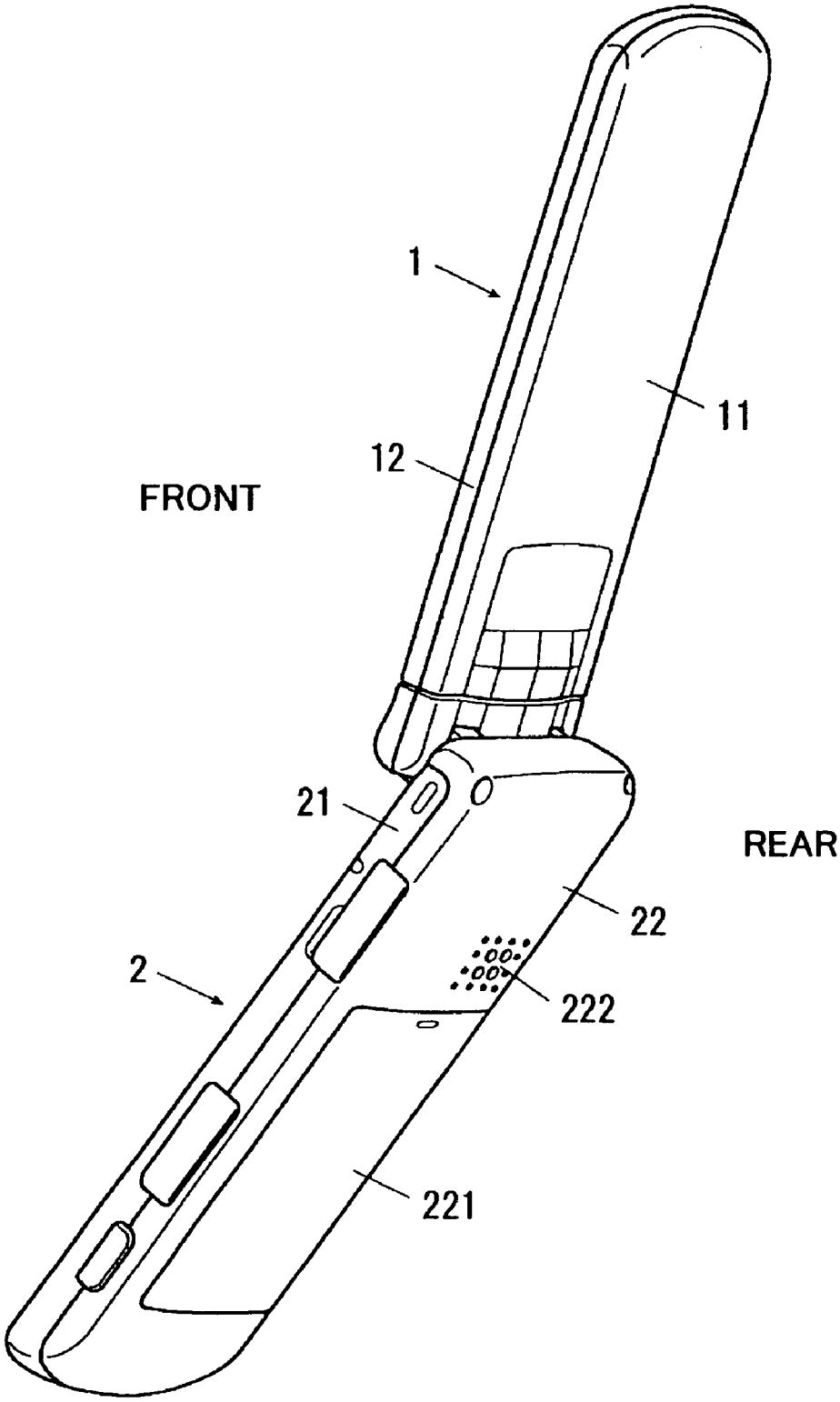
FIG. 2 is a perspective view of the fold type cellular phone of FIG. 1 as viewed from the rear side.

FIGS. 1 and 2 illustrate a cellular phone in an open state, which has an antenna apparatus according to one embodiment of the invention mounted therein. FIG. 1 is a perspective view of the cellular phone as viewed from the front side, and FIG. 2 is a perspective view of the cellular phone as viewed from the rear side.

The cellular phone having the antenna apparatus according to the embodiment mounted therein is a fold type cellular phone. The cellular phone has a first casing 1, a second casing 2, and a hinge portion 3. The first casing 1 and the second casing 2 are rotatably coupled together by the hinge portion 3.

The first casing 1 has case members 11, 12 connected together. The case member 12, which overlies the second casing 2 when the cellular phone is folded, is provided with a receiving unit 121 and a display unit 122.

The second casing 2 has case members 21, 22 connected together. The case member 21, which overlies first casing 1 when the cellular phone is folded, is provided with a transmitting unit 211 and a key operation unit 212. As shown in FIG. 2, a battery cover 221 is fitted in the other case member 22, and speaker outlet holes 222 are formed in the case member 22. In FIG. 1, the display unit 122 of the first casing 1 and the key operation unit 212 of the second casing 2 face frontward.

Figure 3:
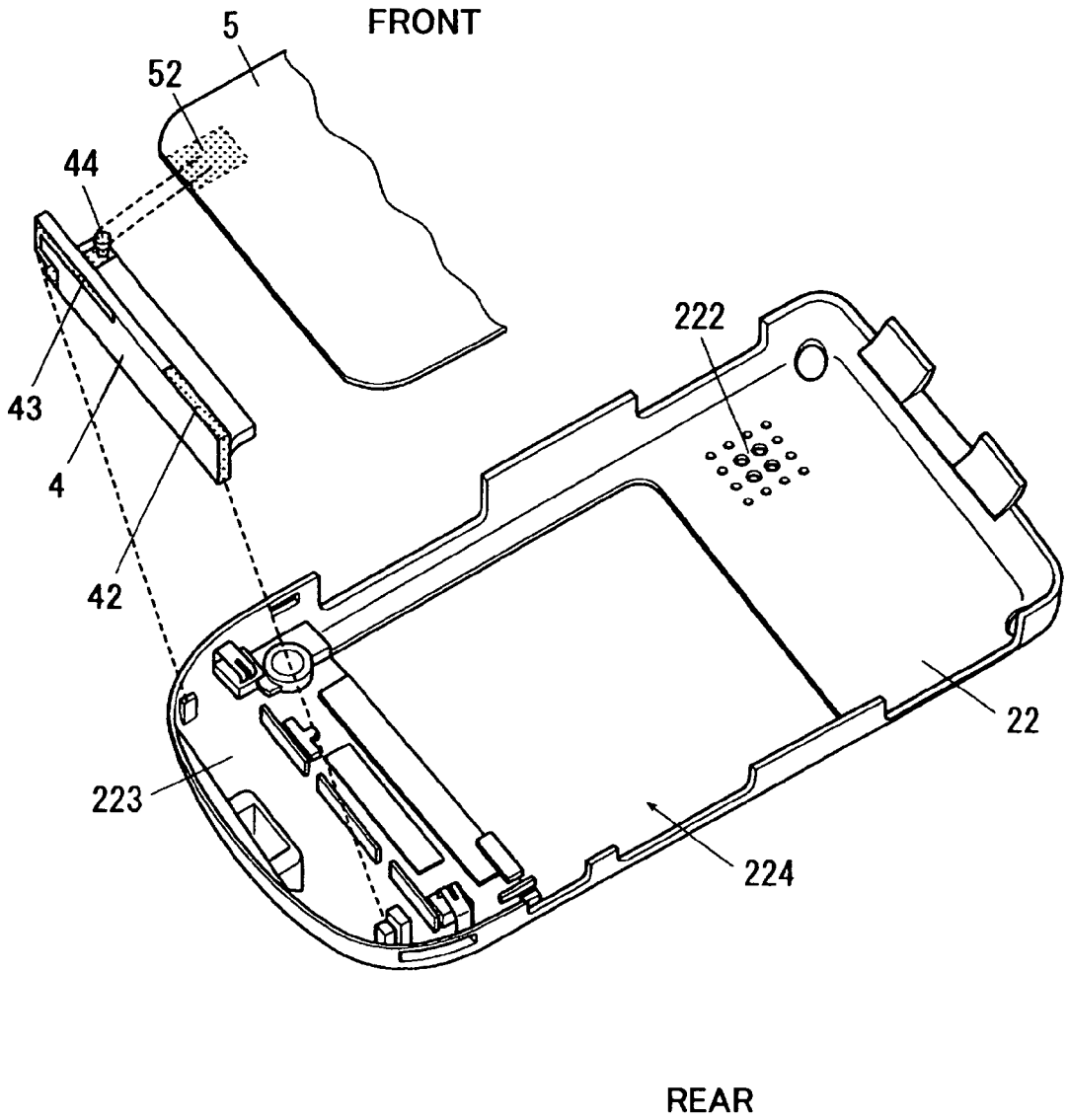
FIG. 3 is an exploded perspective view of a casing of the fold type cellular phone of FIG. 1 where the antenna apparatus is incorporated, showing one case member from inside.

FIG. 3 is an exploded perspective view of a casing of the cellular phone, showing the case member 22 from inside. As shown in FIG. 3, a recessed antenna mount section 223 is formed along one inner end portion of the case member 22. A battery retaining opening 224 is formed in the case member 22. The battery retaining opening 224 is covered with the attachable/detachable battery cover 221.

The antenna apparatus 4 having an L-shaped cross section is fitted in the antenna mount section 223. The antenna apparatus 4 has a first antenna element 42, a second antenna element 43, a power feed pin (power feed point) 44 which feeds drive power to the first antenna element 42 and the second antenna element 43. A substrate 5 has a power supply unit 52. The substrate 5 is fixed inside the second casing 2 so that the power supply unit 52 electrically contacts the power feed pin 44 of the antenna apparatus 4.

Figure 4:
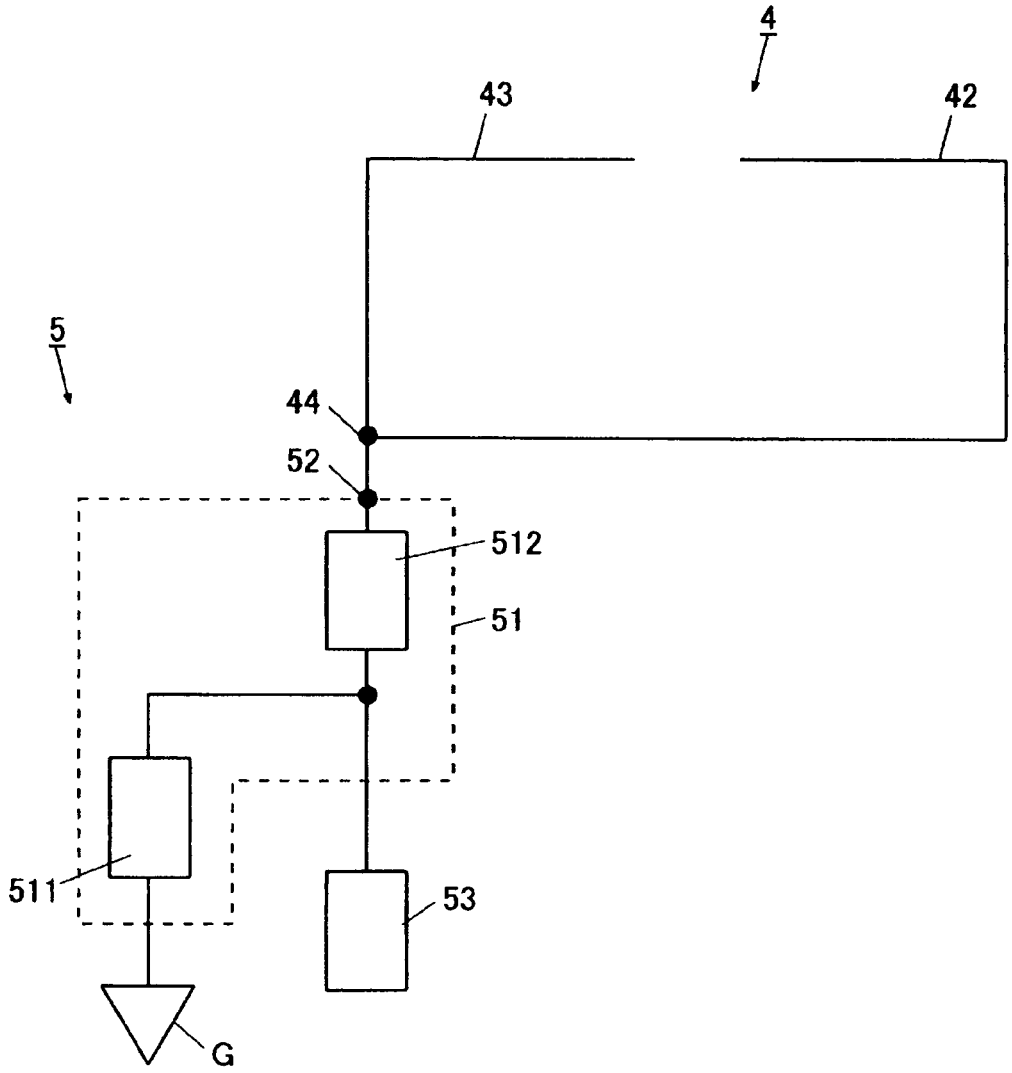
FIG. 4 is an equivalent circuit diagram of a substrate to be connected to the antenna apparatus.

FIG. 4 is an equivalent circuit diagram of the substrate 5 to be connected to the antenna apparatus 4. As shown in FIG. 4, a matching circuit 51 comprising circuit elements 511 and 512, the power supply unit 52, a transmission/reception circuit 53, and a ground G are mounted on the substrate 5. The circuit element 511 is connected to the ground G The circuit elements 511 and 512 are connected to the transmission/reception circuit 53. As the power feed pin 44 is connected to the power supply unit 52, the antenna apparatus 4 is connected to the substrate 5. Power which is matched by the matching circuit 51 of the substrate 5 is supplied to the first antenna element 42 and the second antenna element 43 of the antenna apparatus 4 via the power supply unit 52 and the power feed pin 44.

Figure 5A:
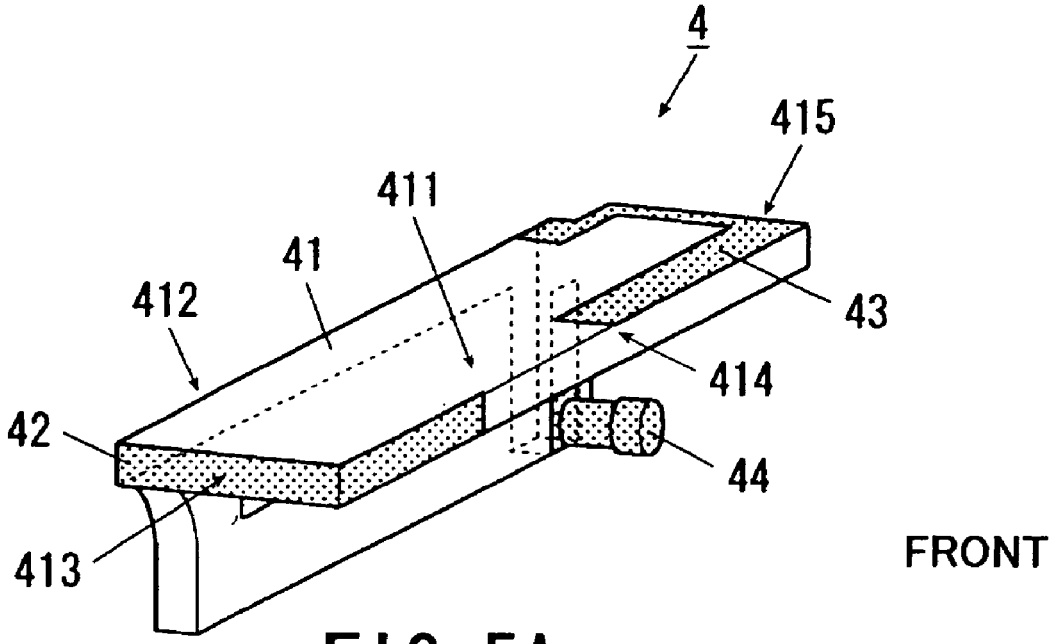
FIG. 5A is a perspective view of the antenna apparatus as viewed from the front side.
Figure 5B:
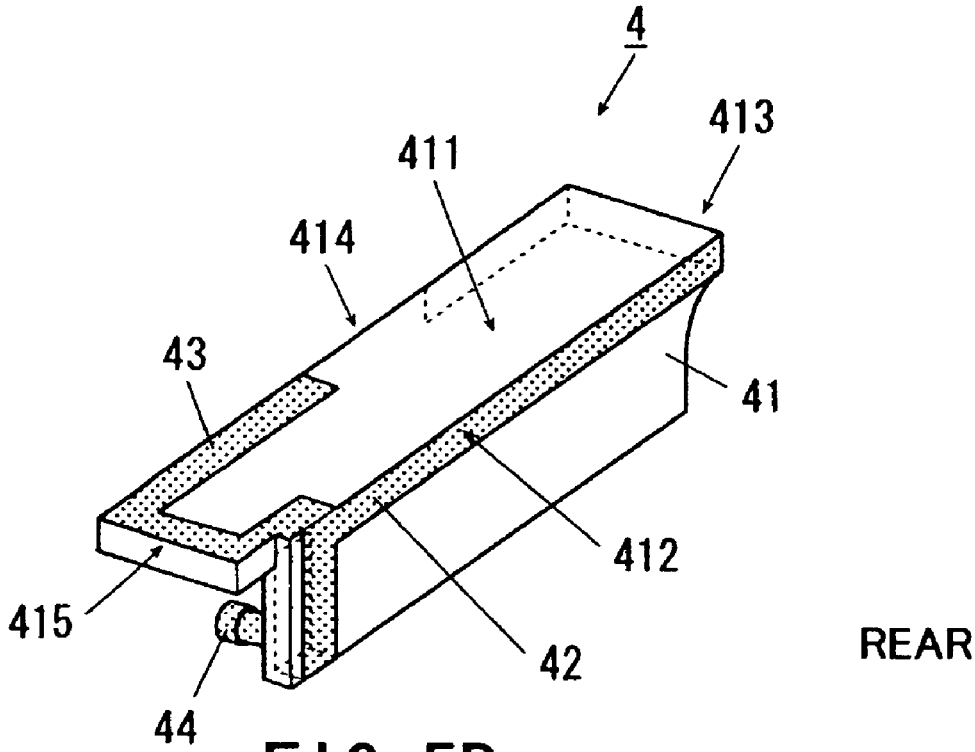
FIG. 5B is a perspective view of the antenna apparatus as viewed from the rear side.

FIGS. 5A and 5B show the configuration of the antenna apparatus 4. FIG. 5A is a perspective view of the antenna apparatus 4 as viewed from the front side, and FIG. 5B is a perspective view of the antenna apparatus 4 as viewed from the rear side. The first antenna element 42 and the second antenna element 43 are formed in the form of a thin film on a support base member 41 having an L-shaped cross section.

The first antenna element 42 and the second antenna element 43 are formed from a single continuous belt-like conductive member branched from the same power feed pin 44, and extend along the surfaces of the support base member 41. Each of the first antenna element 42 and the second antenna element 43 is a modified monopole antenna (also called branched monopole antenna). A conductive member having gold plated on an alloy of, for example, copper and nickel can be used for the first antenna element 42 and the second antenna element 43.

The support base member 41 comprises a member having electric insulation property, such as ABS-based resin. The support base member 41 has a flat face portion 411 and peripheral end faces 412 to 415 approximately orthogonal (approximately perpendicular) to the flat face portion 411. As shown in FIGS. 5A and 5B, the first antenna element 42 is laid out on the peripheral end faces 412, 413 and 414 on the support base member 41, and the second antenna element 43 is laid out on the flat face portion 411. More specifically, the first antenna element 42 is provided along the peripheral end faces 412 to 414 of the support base member 41, and the second antenna element 43 is provided along the peripheral end portion of the flat face portion 411 of the support base member 41. The first antenna element 42 and the second antenna element 43 are arranged on the support base member 41 nearly in a loop as a whole with a predetermined clearance provided between their end faces.

The support base member 41 on which the first antenna element 42 and the second antenna element 43 are provided is mounted to the antenna mount section 223 shown in FIG. 3, and is housed in the second casing 2 of the cellular phone.

The first antenna element 42 and the second antenna element 43 are adjusted to have different lengths corresponding to the frequencies of radio waves to be transmitted and/or received. In the embodiment, the length of the first antenna element 42 is adjusted to be able to transmit/receive radio waves of near 800 MHz (Rx: 843 MHz to 870 MHz, Tx: 898 MHz to 925 MHz), and the length of the second antenna element 43 is adjusted to be able to transmit/receive radio waves of near 2 GHz (Rx: 2110 MHz to 2130 MHz, Tx: 1920 MHz to 1940 MHz). Thus, the antenna apparatus 4 is dual-band antenna apparatus that has the first antenna element 42 and the second antenna element 43 which transmit and/or receive radio waves of different frequency bands.

Figure 6:
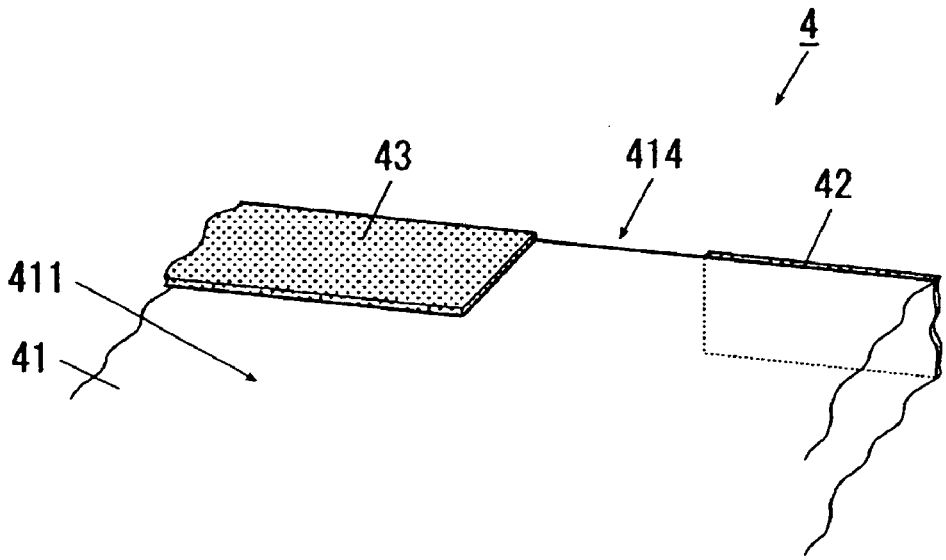
FIG. 6 is a schematic diagram showing the layout relationship between the distal ends of a first antenna element and a second antenna element of the antenna apparatus.

FIG. 6 is a schematic diagram showing the layout relationship between the distal ends of the first antenna element 42 and the second antenna element 43. As mentioned above, the first antenna element 42 and the second antenna element 43 are respectively provided along different sides of the support base member 41. As shown in FIG. 6, therefore, the distal ends of the first antenna element 42 and the second antenna element 43 are arranged approximately orthogonal to each other at positions where the distal ends do not face each other.

More specifically, the first antenna element 42 and the second antenna element 43 extend like elongated plates on the support base member 41 with their distal ends apart from each other by a predetermined distance. The end face of the distal end (distal end face) of each antenna element has an approximately rectangular shape.

The first antenna element 42 is arranged on the peripheral end face 414 along a side thereof which contacts the flat face portion 411 in the vicinity of the distal end of the first antenna element 42. The second antenna element 43 is arranged on the flat face portion 411 along a side thereof which contacts the peripheral end face 414 in the vicinity of the distal end of the second antenna element 43.

Therefore, the lengthwise direction of the distal end face of the first antenna element 42 is approximately parallel to the peripheral end face 414, and the lengthwise direction of the distal end face of the second antenna element 43 is approximately parallel to the flat face portion 411.

In other words, the first-antenna element 42 and the second antenna element 43 are laid out on the support base member 41 in such a way that the lengthwise direction of the distal end face of the first antenna element 42 is approximately perpendicular to the lengthwise direction of the distal end face of the second antenna element 43 and the distal end faces of the first antenna element 42 and the second antenna element 43 do not face each other.

This structure can suppress the sizes of the areas "S" of the opposing distal ends of both antenna elements 42 and 43.

Figure 7:
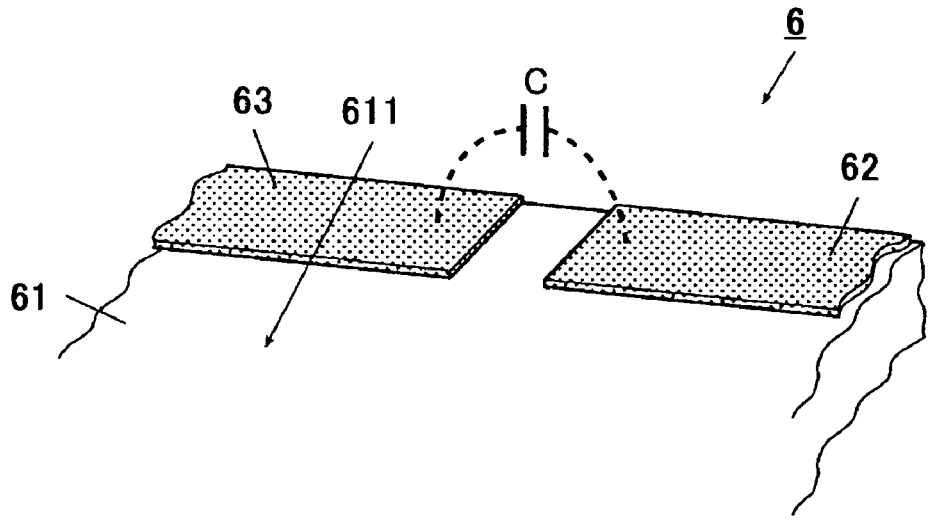
FIG. 7 is a schematic diagram showing a conventional antenna apparatus.
Figure 8:
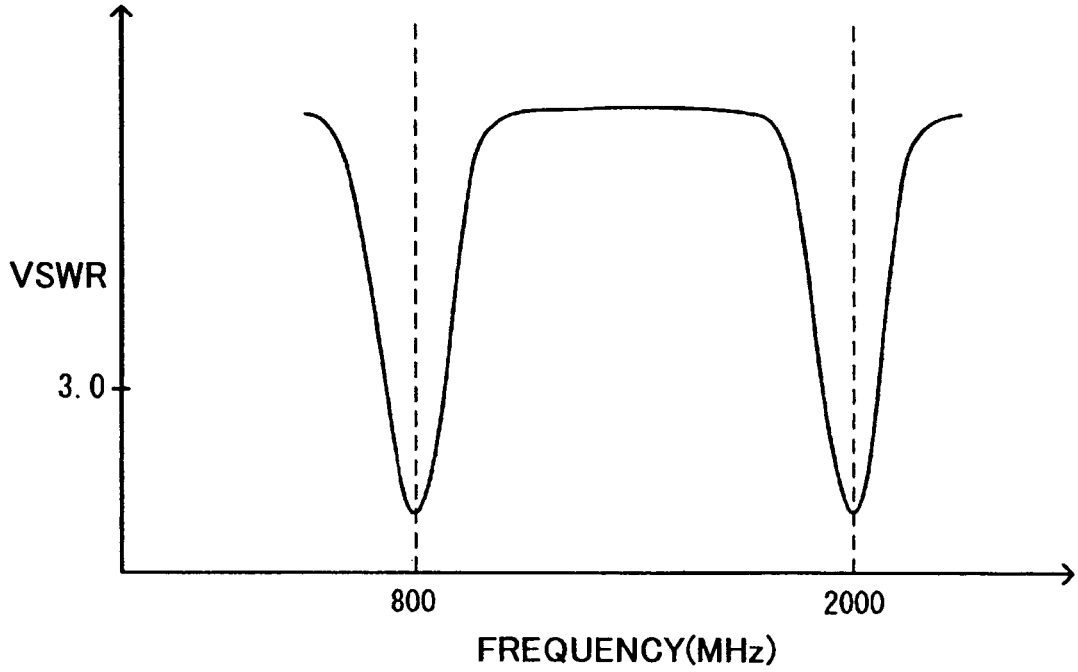
FIG. 8 is a diagram showing the antenna characteristic of the first antenna element and the second antenna element.
Figure 9:
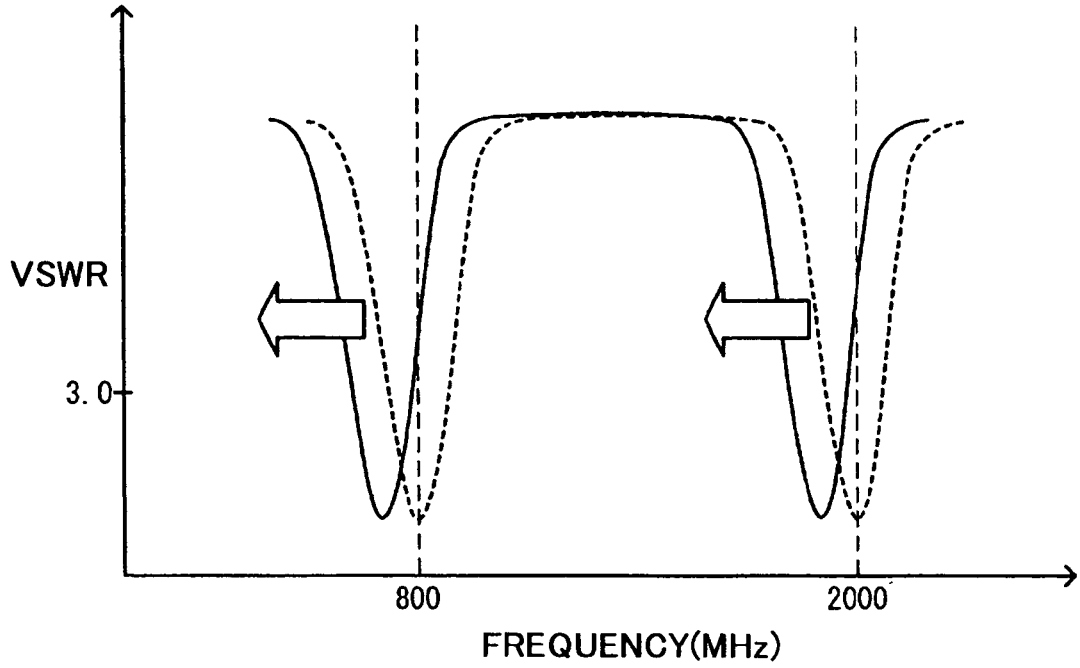
FIG. 9 is a diagram for explaining the interference between antenna elements at the time of adjusting the frequency band.

Specifically, the lengthwise direction of the distal end face of the first antenna element 42 differs from the lengthwise direction of the distal end face of the second antenna element 43. This makes it possible to reduce the areas of the opposing faces of the distal ends as compared with the case of the conventional antenna apparatus shown in FIG. 7 where the lengthwise directions of the distal end faces are parallel to each other.

In addition, the first antenna element 42 and the second antenna element 43 are arranged in such a way that the extension direction of the first antenna element 42 in the vicinity of the distal end thereof and the extension direction of the second antenna element 43 in the vicinity of the distal end thereof are approximately parallel to each other, and the distal end face of the first antenna element 42 does not overlie the imaginary distal end face of the second antenna element 43 when the second antenna element 43 is extended in the extension direction. This can make the areas of the opposing distal ends smaller.

The embodiment can suppress the areas of the opposing distal ends of the antenna elements 42 and 43 which are arranged apart from each other by a predetermined distance. This can suppress the capacitance to be stored between the distal ends of the antenna elements 42 and 43. That is, the electric coupling of the distal ends of the first antenna element 42 and the second antenna element 43 can be reduced.

In the embodiment, as described above, the first antenna element 42 and the second antenna element 43 having different lengths are arranged nearly in a loop as a whole with a predetermined clearance provided between their distal ends. Further, the first antenna element 42 and the second antenna element 43 are arranged in such a way that the lengthwise direction of the end face of the distal end of the first antenna element 42 is approximately orthogonal to the lengthwise direction of the end face of the distal end of the second antenna element 43 and the distal end faces of both antenna elements 42 and 43 do not face each other.

The embodiment therefore has the following advantages. The areas of the opposing distal ends of the antenna elements can be suppressed. The electric coupling of the antenna elements can be reduced, thereby improving the antenna performances of the antenna elements. Further, it is possible to make the work of adjusting the frequency bands of radio waves to be transmitted/received by the antenna elements easier.

In the embodiment, the first antenna element 42 and the second antenna element 43 respectively have lengths corresponding to the frequencies of radio waves to be transmitted and/or received by the antenna elements. According to the embodiment, the antenna elements can transmit and/or receive radio waves of different frequencies.

In the embodiment, the first antenna element 42 and the second antenna element 43 are each formed in the form of a thin film on the support base member 41 that has an electric insulation property. The embodiment can therefore make the antenna apparatus compact.

In the embodiment, the first antenna element 42 and the second antenna element 43 are respectively provided on different sides of the support base member 41. Therefore, the antenna elements can be arranged three-dimensionally. This can allow the antenna elements to be arranged close to each other, thereby making the antenna apparatus compact.

In the embodiment, the first antenna element 42 is provided on the peripheral end faces 412 to 414 of the support base member 41, and the second antenna element 43 is provided on the flat face portion 411 of the support base member 41 along the peripheral end portion thereof. According to the embodiment, a plurality of antenna elements can be arranged nearly in a loop as a whole at positions where the distal end faces of the antenna elements are approximately orthogonal to one another and do not face one another. This makes it possible to suppress the electrode areas in a case where the distal ends of the antenna elements function as a capacitor, thereby reducing the electric coupling of the antenna elements.

In the embodiment, the support base member 41 is provided retainable in the second casing 2 of the portable communication terminal apparatus. According to the embodiment, the antenna apparatus described above can be used in the portable communication terminal apparatus.

The embodiment is just an example of the antenna apparatus according to the invention, which is in no way limited to the embodiment. The detailed structure and the detailed operation of the antenna apparatus according to the embodiment can be modified as needed without departing from the scope and spirit of the invention.

A 1-power and 2-resonance, dual-band antenna has been explained in the foregoing description of the embodiment. However, the invention is not limited to this particular type, but can be adapted to multiband antennas, such as 1-power and multi-resonance type and multi-power and multi-resonance type.

In the embodiment, the support base member 41 has an L-shaped cross section. This is not restrictive; for example, it is possible to use the support base member 41 which has another shape like one having a ]-shaped cross section or one having a rectangular box shape.

In the embodiment, the invention is adapted to an antenna apparatus 4 for a cellular phone (portable communication terminal apparatus) as an example. However, the invention is not limited to this case, and can be adapted to various wireless communication apparatuses, such as a wireless LAN apparatus.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2006-033603 filed on Feb. 10, 2006 and including specification, claims, drawings and summary. The disclosure of the above Japanese Patent Application is incorporated herein by reference in its entirety.

What is claimed is:

1. An antenna apparatus having at least two antenna elements branched from one power feed point, wherein the at least two antenna elements have different lengths, and a first antenna element of the at least two antenna elements and a second antenna element of the at least two antenna elements are arranged nearly in a loop with a predetermined clearance provided between distal ends of the first and second antenna elements, such that end faces of the distal ends of the first and second antenna elements do not face each other, a lengthwise direction of an end face of the distal end of the first antenna element being approximately perpendicular to a lengthwise direction of the end face of the distal end of the second antenna element, and wherein each of the lengths of the at least two antenna elements corresponds to a frequency of a radio wave which each of the at least two antenna elements at least one of transmits and receives.

2. The antenna apparatus according to claim 1, wherein each of the at least two antenna elements is formed on a support base member having an electric insulation property in a form of a thin film.

3. The antenna apparatus according to claim 2, wherein the at least two antenna elements are provided on different sides of the support base member.

4. The antenna apparatus according to claim 3, wherein the first antenna element is provided on a peripheral end face of the support base member, and the second antenna element is provided on a flat face portion of the support base member along a peripheral end portion thereof

5. The antenna apparatus according to claim 2, wherein the support base member is provided retainable in a casing of a portable communication terminal apparatus.

6. An antenna apparatus comprising:

a first antenna element which at least one of transmits and receives radio waves of a predetermined frequency band;

a second antenna element which at least one of transmits and receives radio waves of a frequency band different from the predetermined frequency band;

wherein the first antenna element and the second antenna element are arranged nearly in a loop with distal ends thereof being apart from each other by a predetermined distance, such that a lengthwise direction of an end face of a distal end of the first antenna element is different from the lengthwise direction of an end face of the distal end of the second antenna element, and such that an extension direction of the first antenna element near the distal end of the first antenna element is approximately parallel to an extension direction of the second antenna element near the distal end of the second antenna element.

7. The antenna apparatus according to claim 6, wherein the first antenna element and the second antenna element are arranged in a vicinity of each other such that the lengthwise direction of the end face of the distal end of the first antenna element is approximately perpendicular to the lengthwise direction of the end face of the distal end of the second antenna element.

8. The antenna apparatus according to claim 6, wherein the first antenna element and the second antenna element are arranged such that the end face of the distal end of the first antenna element does not overlie an imaginary end face of the distal end of the second antenna element when the second antenna element is extended in the extension direction.

9. An antenna apparatus having at least two antenna elements branched from one power feed point, wherein the at least two antenna elements have different lengths, a first antenna element of the at least two antenna elements and a second antenna element of the at least two antenna elements are arranged nearly in a loop with a predetermined clearance provided between distal ends of the first antenna element and the second antenna element, each of the at least two antenna elements is arranged on a support base member, and the first antenna element is provided on a peripheral end face of the support base member, and the second antenna element is provided on a flat face portion, which is different from the peripheral end face, of the support base member along a peripheral end portion thereof.

10. The antenna apparatus according to claim 9, wherein the first antenna element and the second antenna element are arranged such that an extension direction of the first antenna element near the distal end the first antenna element is approximately parallel to the extension direction of the second antenna element near the distal end of the second antenna element.

11. An antenna apparatus having at least two antenna elements branched from one power feed point, wherein the at least two antenna elements have different lengths, and a first antenna element of the at least two antenna elements and a second antenna element of the at least two antenna elements are arranged nearly in a loop with a predetermined clearance provided between distal ends of the first and second antenna elements, such that end faces of the distal ends of the first and second antenna elements do not face each other, a lengthwise direction of an end face of the distal end of the first antenna element being approximately perpendicular to a lengthwise direction of the end face of the distal end of the second antenna element, each of the at least two antenna elements is formed on a support base member having an electric insulation property in a form of a thin film, the at least two antenna elements are provided on different sides of the support base member, and wherein the first antenna element is provided on a peripheral end face of the support base member, and the second antenna element is provided on a flat face portion of the support base member along a peripheral end portion thereof.

* * * * *